US010910724B2

(12) United States Patent
Gambahaya

(10) Patent No.: US 10,910,724 B2
(45) Date of Patent: Feb. 2, 2021

(54) TRACE ANTENNAS AND CIRCUIT BOARD INCLUDING TRACE ANTENNAS

(71) Applicant: TAOGLAS GROUP HOLDINGS LIMITED, Enniscorthy (IE)

(72) Inventor: Sifiso Gambahaya, Wexford (IE)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 22 days.

(21) Appl. No.: 16/176,742

(22) Filed: Oct. 31, 2018

(65) Prior Publication Data

US 2019/0199000 A1 Jun. 27, 2019

(30) Foreign Application Priority Data

Nov. 7, 2017 (GB) ..... 1718424.3

(51) Int. Cl.
*H01Q 1/38* (2006.01)
*H01Q 9/42* (2006.01)
(Continued)

(52) U.S. Cl.
CPC ..... *H01Q 9/42* (2013.01); *H01Q 1/2283* (2013.01); *H01Q 1/243* (2013.01); *H01Q 1/38* (2013.01);
(Continued)

(58) Field of Classification Search
CPC ..... H01Q 9/42; H01Q 13/10; H01Q 13/106; H01Q 13/16; H01Q 1/22; H01Q 1/2283;
(Continued)

(56) References Cited

U.S. PATENT DOCUMENTS 5,828,342 A * 10/1998 Hayes ..... H01Q 1/38 343/702
6,239,765 B1 * 5/2001 Johnson ..... H01Q 1/243 343/702
(Continued)

FOREIGN PATENT DOCUMENTS

EP 2280447 2/2011
EP 2597724 5/2013
(Continued)

*Primary Examiner* — Tho G Phan
(74) *Attorney, Agent, or Firm* — Garson & Gutierrez, PC

(57) ABSTRACT

Disclosed are multi-band trace antennas and circuit boards including a multi-band trace antenna for the transmission and/or reception of information in a wireless communication system. The circuit board is configurable to include a multi-band trace antenna. Additionally, the circuit board can comprise a feed point adjacent an edge of the circuit board, the feed point being connected to a pair of closely coupled traces of unequal length, a first of the traces extending away from the feed point along the edge of the circuit board, and a second of the traces extending away from the feed point inboard of the first antenna trace, the circuit board comprises a ground plane coplanar with the traces, an edge of the ground plane extending alongside and closely coupled with the second of the traces to cause an area of the ground place adjacent the edge to radiate at a selected lower operational frequency of the antenna, wherein an edge of a longer of the pair of closely coupled traces is indented to vary a width of the trace at a plurality of points along its length and to increase radiation of the shorter of the pair of closely coupled traces at a selected higher operational frequency of the antenna.

23 Claims, 6 Drawing Sheets

(51) Int. Cl.

| | |
|---|---|
| ***H01Q 1/24*** | (2006.01) |
| ***H01Q 5/371*** | (2015.01) |
| ***H01Q 1/22*** | (2006.01) |
| ***H01Q 9/40*** | (2006.01) |
| *H01Q 7/00* | (2006.01) |
| *H01Q 13/10* | (2006.01) |
| *H01Q 13/16* | (2006.01) |

(52) U.S. Cl.
CPC ..... *H01Q 5/371* (2015.01); *H01Q 9/40* (2013.01); *H01Q 7/00* (2013.01); *H01Q 13/106* (2013.01); *H01Q 13/16* (2013.01)

(58) Field of Classification Search
CPC ..... H01Q 1/24; H01Q 1/243; H01Q 1/38; H01Q 5/37; H01Q 5/371; H01Q 7/00; H01Q 9/40
See application file for complete search history.

(56) References Cited

U.S. PATENT DOCUMENTS

| | | | | |
|---|---|---|---|---|
| 6,943,749 | B2 * | 9/2005 | Paun | H01Q 1/38 343/700 MS |
| 8,599,093 | B2 * | 12/2013 | Ridgeway | H01Q 1/243 343/860 |
| 8,810,467 | B2 * | 8/2014 | Lee | H01Q 1/38 343/817 |
| 2005/0259031 | A1 * | 11/2005 | Sanz | H01Q 1/243 343/895 |
| 2010/0182202 | A1 | 7/2010 | Shih | |
| 2010/0315294 | A1 | 12/2010 | Chang et al. | |
| 2014/0009358 | A1 | 1/2014 | Yang et al. | |

FOREIGN PATENT DOCUMENTS

| | | |
|---|---|---|
| EP | 2665125 | 11/2013 |
| WO | 2010122220 | 10/2010 |

* cited by examiner

TRACE ANTENNAS AND CIRCUIT BOARD INCLUDING TRACE ANTENNAS

CROSS-REFERENCE

This application claims priority to UK Patent Application Serial No. 1718424.3 filed Nov. 7, 2017, entitled A CIRCUIT BOARD INCLUDING A TRACE ANTENNA, which application is incorporated herein by reference in its entirety.

BACKGROUND

Field

The present disclosure relates to circuit boards including a small form factor trace antenna that can provide a multiple-band frequency response.

Background

Long Term Evolution (LTE) is an example of a multi-band based communications standard and an increasing number of high tech electronic devices are being designed to function over LTE operating frequency bands.

LTE operating frequency bands are relatively widespread which gives rise to greater potential impact from detuning effects. Thus, achieving wideband performance in a single small form factor antenna for an LTE device is a difficult objective.

Antennas, such as a monopole trace antenna, are well known in the art. Depending on the frequency response that is desired, the specific arrangement of the antenna trace(s) are configured to provide a response in a desired operating frequency band(s), including for example, LTE bands.

Typically, however, monopole trace antennas are arranged so the trace(s) is/are arranged to extend away from an edge of a ground plane on a circuit board. Such configuration minimizes the coupling effect the ground plane of the circuit board has on the radiating element(s) of the monopole trace antenna. Ground plane coupling may be problematic as the coupling effects of the ground plane may have an impact on the frequency response of the antenna such as shifting the frequency response for the bands of interest, reducing the voltage standing wave ratio (VSWR), reducing the reflection coefficient response, or varying the bandwidth of the antenna which in turn results in a reduction in the efficiency and/or gain of the antenna at the desired frequency band(s). Traditional antenna arrangements however, can involve allocating a relatively large portion of circuit board area to the antenna and this may not be acceptable or possible in some applications.

Thus, there are a number of problems associated with providing a trace antenna configured for multiple resonances and spanning a wideband spectrum with high efficiency and/or gain.

What is needed are trace antennas configured for multiple resonances spanning a wideband spectrum with high efficiency and/or gain and circuit boards incorporating such antennas.

SUMMARY

An aspect of the disclosure is directed to circuit boards including a multi-band trace antenna. Suitable circuit board comprise: a feed point adjacent an edge of the circuit board, the feed point being connected to a first antenna trace closely coupled to a second antenna trace wherein the first antenna trace and the second antenna trace are of unequal length, and further where the first antenna trace extends away from the feed point along the edge of the circuit board, and the second antenna trace extends away from the feed point inboard of the first antenna trace, the circuit board comprising: a ground plane coplanar with the first antenna trace and the second antenna trace, an edge of the ground plane extending alongside and closely coupled with the second antenna trace to cause an area of the ground place adjacent the edge of the ground plane to radiate at a selected lower operational frequency of the antenna, wherein an edge of the second antenna trace is indented to vary a width of the second antenna trace at a plurality of points along a length of the second antenna trace and to increase radiation of the first antenna trace at a selected higher operational frequency of the antenna. In some configurations, the second antenna trace is indented by one or more of: a square shaped section, a rectangular shaped section, a triangular shaped section, an irregular shaped section, an undulating indentation, and a combination of different shaped sections. The second antenna trace can be indented at a first end of the second antenna trace, where the first end is an end closest to the feed point, and indented at a second end of the first antenna trace, the second end displaced away from the feed point and at an opposite end from the first end. Additionally, the second antenna trace can be spaced away from the edge of the ground plane by a distance of about 0.6 mm in some configurations. The first antenna trace can be spaced away from the second antenna trace by a distance of about 0.7 mm. Additionally, the multi-band trace antenna comprises a monopole antenna, such as a multi-band trace antenna configured to operate in a frequency range of 600 MHz, to 2.7 GHz. In some configurations, a dielectric of the circuit board and a trace of the feed point are chosen to match an impedance of the antenna with a transceiver circuit. The feed point can also comprise one of a Pi matching network or a T matching network. The circuit board can further comprise a printed circuit board. The second antenna trace is configurable in some embodiments to comprise a loop section extending in a direction away from the ground plane. The loop section of the second trace can further be configured to overlap at least a portion of the first antenna trace. The loop section can be configured to extend in a direction away from the ground plane by about 8 mm. Additionally, the circuit board can further comprise a pair of wings, wherein the pair of wings extend outwards along the edge of the circuit board, each wing of the pair of wings being separated to define a gap and wherein the loop section extends over a surface of one of the wings.

Another aspect of the disclosure is directed to circuit boards including a multi-band Planar Inverted-F Antenna, PIFA. The circuit boards comprise: a feed point adjacent an edge of the circuit board, the feed point being connected to a plurality of traces, a first antenna trace of the plurality of traces extending away from the feed point along the edge of the circuit board, a second antenna trace of the plurality of traces extending away from the feed point inboard of the first antenna trace, the first antenna trace and the second antenna trace being of unequal length and being closely coupled along a coextensive length, the longer of the first antenna trace and the second antenna trace further comprising a loop section extending in a direction away from the ground plane, and a third antenna trace of the plurality of traces extending away from the feed point in a direction opposite that of the first antenna trace and the second antenna trace, the circuit board comprising a ground plane coplanar with the plurality of traces, an edge of the ground plane extending alongside and closely coupled with the second antenna trace of the plurality of traces to cause an area of the ground place adjacent the edge to radiate at a selected lower operational frequency of the PIFA, and a pair of wings, wherein the pair of wings extend outwards along the edge of the circuit board, each wing of the pair of wings being separated to define a gap and wherein the loop section extends over a surface of one of the wings and the third trace extends over a surface of the other of the wings. In some configurations, the second antenna trace of the plurality of traces is spaced away from the edge of the ground plane by a distance of about 0.6 mm. Additionally, the first antenna trace of the plurality of traces can be spaced away from the second antenna trace by a distance of about 0.7 mm. The multi-band trace antenna is configurable to operate in a frequency range of 600 MHz, to 2.7 GHz. A dielectric of the circuit board and at least one trace of the feed point are chosen to match the impedance of the antenna with a transceiver circuit.

Still another aspect of the disclosure is directed to multi-band trace antennas. Suitable antennas comprise: a first antenna trace having a first length; a second antenna trace having a second length different than the first length of the first antenna trace; a feed point connected to the first antenna trace and the second antenna trace wherein the first antenna trace extends away from the feed point in a first direction, and the second antenna trace extends away from the feed point in the first direction inboard of the first antenna trace, and further wherein an edge of the second antenna trace is indented to vary a width of the second antenna trace at a plurality of points along a length of the second antenna trace and to increase radiation of the first antenna trace at a selected higher operational frequency of the antenna. Additionally, the second antenna trace can be indented by one or more of: a square shaped section, a rectangular shaped section, a triangular shaped section, an irregular shaped section, an undulating indentation, and a combination of different shaped sections. The second antenna trace can also be indented at two different sections of the antenna trace, at a first end of the second antenna trace, the first end being an end closest to the feed point, and indented at a second end of the first antenna trace, the second end displaced away from the feed point and at an opposite end from the first end. Additionally, in some configurations, the second antenna trace is spaced away from the edge of the ground plane by a distance of about 0.6 mm and/or the first antenna trace is spaced away from the second antenna trace by a distance of about 0.7 mm. The multi-band trace antenna can comprise a monopole antenna. Additionally, the antennas are configurable to operate in a frequency range of 600 MHz, to 2.7 GHz. The feed point is further configurable to comprise one of a Pi matching network or a T matching network. A loop section can be provided on the second antenna trace extending in a direction toward the feed point. The loop section can also overlap at least a portion of the first antenna trace in some configurations. In some configurations, a third antenna trace extending away from the feed point in a direction opposite that of the first antenna trace and the second antenna trace is provided.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1:
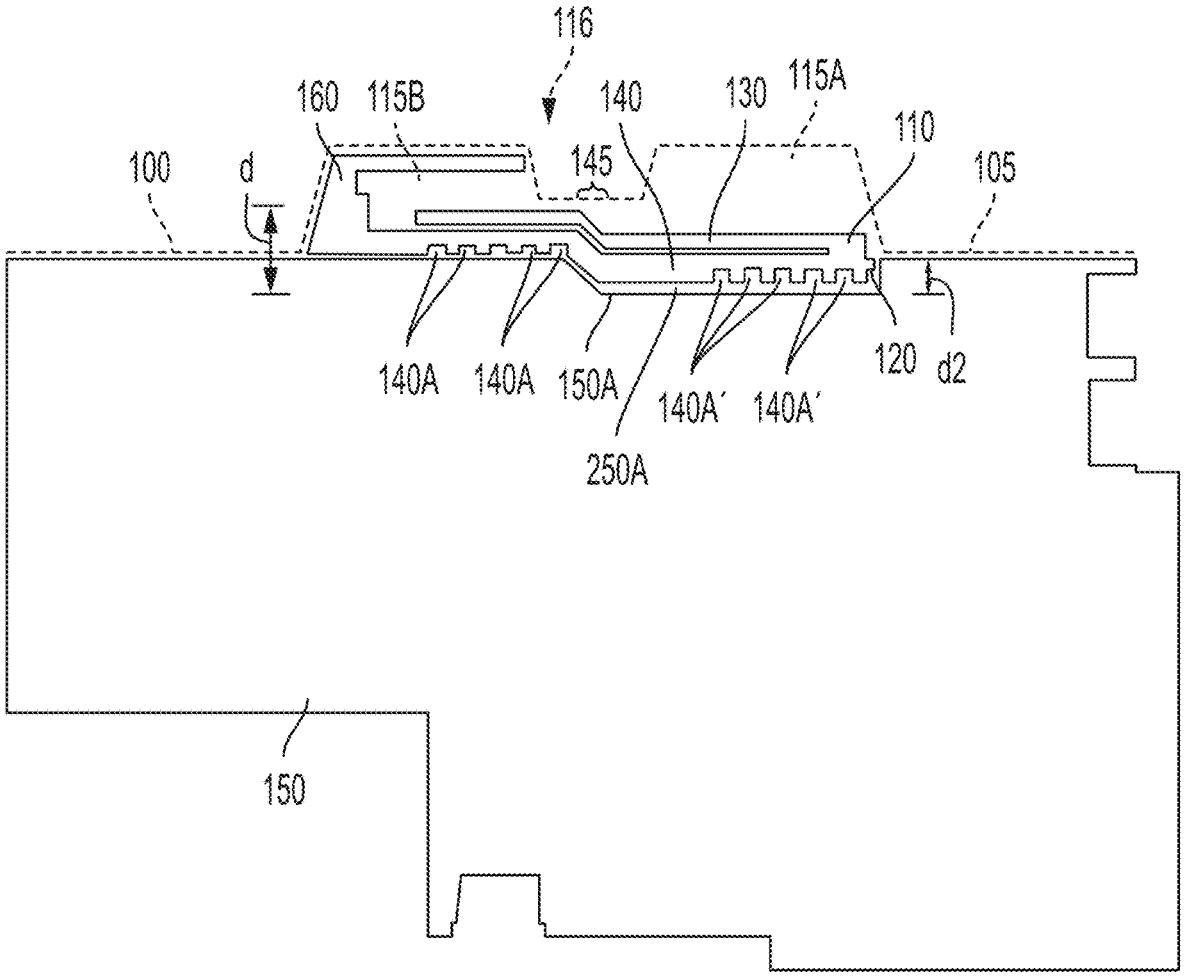
FIG. 1 is a plan view of one layer of a circuit board comprising a trace antenna according to a configuration of the present disclosure.

Referring to the drawings, a circuit board 100 for an electronic system such as a wireless communication device or data terminal, is described. The circuit board 100 may be a multi-layer circuit board and may be, but is not limited to, a printed circuit board (PCB). Such a circuit board 100 may be arranged to allow, for example, placement and integration of electronic components (not shown) and may also incorporate various traces, vias and/or wire bonds for transmission/reception of electrical signals between the components. Such electronic components and traces are connectable to form and operate as an electronic system or sub-system. The assembled electronic (sub-) system provides a wireless connection as well as possibly a direct electrical connection to other systems or sub-systems. For the wireless electronic system, or sub-system, to operate in a proper fashion requires an antenna that operates in the required frequency bands.

In one application, the assembled sub-system comprises a communications board for a vehicle with the circuit board connecting through a network connection such as a controller area network (CAN) bus to other vehicle sub-systems. It is known for such communications boards to be connected to an external antenna to enable external communications to and from a vehicle. However, in the event of the external antenna being disabled, it can be desirable for the communications board to incorporate a back-up antenna to enable for example emergency communication to and from the vehicle. The space available for accommodating, and the resources available for implementing, such an antenna are limited even though the device may be required to function over wide operating frequency bands such as LTE. Thus, implementing antennas of the disclosure with traces enables using as little circuit board space as possible. It should also be noted that such communications boards are located inside the body of a vehicle possibly even adjacent a roof panel and this poses significant challenges for providing an antenna which can perform suitably.

In FIG. 1, the circuit board 100 is shown with an irregularly shaped outline arranged to locate within a dedicated housing (not shown). However, as will appreciated from the following description, the shape need not be irregular and the circuit board 100 could assume any shape with at least one edge extending long enough to accommodate the traces of an antenna described in more detail below.

In the example, a pair of wings including a first wing 115A and a second wing 115B extend outward along a circuit board edge 105. The outline of the first wing 115A and the second wing 115B conforms to an inner area of the housing, the housing having an indentation along its outside corresponding to a wing gap 116 between the first wing 115A and the second wing 115B. Such a wing gap 116 can be used, for example, to incorporate a closure or mounting mechanism for a housing.

One layer of the circuit board 100 is configurable to include an antenna 110, such as a multi-band trace antenna, and ground plane 150. The antenna 110 may be, for example but not limited to, a multi-band trace antenna such as a dual-band trace antenna. The antenna 110 is incorporatable within the layer towards the circuit board edge 105. The ground plane 150 can be co-extensive or substantially co-extensive with the edges of the circuit board 100 other than the circuit board edge 105 along which the antenna 110 is located. In FIG. 1, the circuit board edge 105 is shown, whereas the remaining edges of the circuit board 100 are not shown in the example, since the remaining edges are co-extensive or substantially co-extensive with the edges of the ground plane 150. The illustrated layer may comprise an external layer of the circuit board 100 typically opposite a surface of the circuit board 100 to which components are mounted, but it will be appreciated that the layer could equally be a layer encapsulated within the circuit board 100.

The ground plane 150 is shown as being continuous, however, it will be appreciated that where via holes (not shown) extend through the circuit board 100 to connect traces at various levels of the circuit board 100 and components mounted on the circuit board 100, the vias will extend through or through to the ground plane 150. In these configurations, unless the vias are connected to ground signals, the vias will be isolated from the ground plane 150 using conventional layout techniques.

In one configuration, the antenna 110 comprises a monopole trace antenna with a feed point 120 located adjacent to the circuit board edge 105. The feed point 120 is connected to a pair of closely coupled traces, first antenna trace 130 and second antenna trace 140, of unequal length. The first antenna trace 130 and second antenna trace 140 extend away from the feed point 120 generally in a parallel manner adjacent an edge of the circuit board 100. The longer of the traces, second antenna trace 140, is provided to enable the antenna 110 to be tuned to lower operational frequencies, whereas the shorter of the traces, first antenna trace 130, is provided to enable the antenna 110 to be tuned to higher operational frequencies. The first antenna trace 130 can be configurable to have a generally constant width, as illustrated, of about 2 mm, whereas the second antenna trace 140 can be configurable to have a greater width than the width of the first antenna trace, such as a maximum width of approximately 4 mm.

The feed point 120 may be a planar connection to the pair of closely coupled traces via for example a coplanar wave guide or microstrip (not shown) and/or may be connected via an impedance matching circuit (not shown) to a wireless communication component such as an RF transceiver incorporated in or on the circuit board 100. The impedance matching circuit may be a Pi-network arrangement or a T-network arrangement of discrete components, so enabling setting of the impedance of the antenna for optimum transmission and/or reception performance in terms of antenna efficiency and/or gain.

The length of the first antenna trace 130 and the second antenna trace 140 is such that the antenna traces achieve a required frequency resonance within particular frequency bands of interest, the frequency bands of interest being the frequency of operation of, for example, the wireless communication component. The frequency of operation may be configured for LTE cellular technology but may also be configured for, but not limited to, Global System for Mobile Communication (GSM), Code-Division Multiple Access (CDMA), Universal Mobile Telecommunications System (UMTS) technologies, other communications standards, such as WiFi or a combination of communications standards.

As noted above, the first antenna trace 130 of the pair of traces extends away from the feed point 120 generally along a length of the circuit board edge 105. The second antenna trace 140 of the pair of traces also extends away from the feed point 120 inboard of the first antenna trace 130 and adjacent an ground plane edge 150A of the ground plane 150. A constant gap 250B of about 0.7 mm is provided along a length between the first antenna trace 130 and the second antenna trace 140 where the first antenna trace 130 and the second antenna trace 140 coextend so that the two traces are separate but closely coupled to one another.

The ground plane edge 150A of the ground plane 150 extends alongside the second 140 of the traces generally with an irregular gap 250A between the ground plane edge 150A of the ground plane 150 and the inboard edge of the second antenna trace 140 of about 0.6 mm. This close coupling of the second antenna trace 140 and the ground plane 150 causes an area of the ground plane 150 adjacent the ground plane edge 150A to radiate at a selected lower operational frequency of the antenna 110, in the case of LTE for example, between 699 MHz and 800 MHz.

Thus, when the ground plane 150 is excited by the close coupling of the second antenna trace 140 at the lower operating frequency, the region of the ground plane 150 adjacent the ground plane edge 150A forms a component of the antenna radiating elements.

An inboard edge of a second antenna trace 140 of the pair of closely coupled traces has a set of first trace indentations 140A and a set of second trace indentations 140A' to vary a width of the second antenna trace 140 at a plurality of points along its length. The set of first trace indentations 140A and/or the set of second trace indentations 140A' may be of a form, for example but not limited to: square shaped sections (as shown), rectangular shaped sections, triangular shaped sections, irregular shaped sections, undulating indentations or a combination of different shaped sections.

The first trace indentations 140A and the second trace indentations 140A' reduce the width of the second antenna trace 140 by 2 mm, about 50% of the trace width. The second antenna trace 140 can be divided into two sections: a first section of the second antenna trace 140 has a plurality of first trace indentations 140A disposed towards an end of the second antenna trace 140 adjacent the end of the first antenna trace 130; and a second section of the second antenna trace 140 has a plurality of second trace indentations 140A' disposed towards the feed point end of the second antenna trace 140 As illustrated, each of the first trace indentations 140A and the second trace indentations 140A' comprises 5 indentations. However, it will be appreciated variants of the illustrated indentations can include variations in the number, shape, and distribution of the indentations along the length of the second antenna trace 140 without departing from the scope of the disclosure. The only requirement being that the indentations be located along the length of the second antenna trace 140 where it is closely coupled with the first antenna trace 130.

As well as also effecting the frequency response at the lower operational frequency range, the arrangement of the first trace indentations 140A and the second trace indentations 140A' are positioned at a plurality of points along the length of the second antenna trace 140 increases radiation of the first antenna trace 130 of the pair of closely coupled traces at a selected higher operational frequency of the antenna 110, for example 1.9 GHz, 2.1 GHz and/or 2.7 GHz frequencies as will be illustrated below.

Where the circuit board space provided by the second wing 115B permits, the second antenna trace 140 of the pair of closely coupled traces comprises a second antenna trace loop section 160. The second antenna trace loop section 160 extends away from the ground plane edge 150A of the ground plane by about 8 mm before looping back on itself by about 25 mm to overlap at least a portion of the first antenna trace 130 of the pair of closely coupled traces.

Each of the first antenna trace 130 and the second antenna trace 140 can also include a trace bend section 145 which shifts the path of each of the traces and the ground plane edge 150A of the ground plane 150 outward from the main body of the circuit board 100 into the body of the second wing 115B over a transition length of between about 4.1 and 5.6 mm—while maintaining the mutual spacing of the traces and the ground plane. This reduces the amount of space required by the antenna traces within the main body of the circuit board 100, instead occupying the second wing 115B.

The second antenna trace loop section 160 is however optional and it will be seen that without this section, the depth of the antenna from the circuit board edge 105 need not extend d mm, with the rectangular circuit board area required to accommodate the antenna extending no more than w×d $mm^2$: with w corresponding to the length of the longer trace; and d corresponding to the distance between the first antenna trace outer edge 230A and the second antenna trace inner edge 240A. In the illustrated configuration w=73.25 mm.

It will also be noted that because of the use of the wing space of both the first wing 115A and the second wing 115B, the trace antenna extends by no more than a depth d2 into a main body of the circuit board 100.

As will be appreciated by those skilled in the art, if neither the second antenna trace loop section 160 nor the trace bend section 145 were provided, the overall depth of the antenna 110 could be reduced to d3<d, i.e. the combined width of the first antenna trace 130 and the second antenna trace 140 as well as the constant gap 250B between the first antenna trace 130 and the second antenna trace 140 would be about 6.7 mm.

Thus, if provided beside a straight edge of a ground plane 150, such an antenna 110 need not occupy an area greater than d3×w mm of the circuit board 100.

Such a small form factor of the antenna 110 is enabled through the close coupling arrangement of the first antenna trace 130 and the second antenna trace 140, the coupling of the second antenna trace 140 and the ground plane 150 and the set of first trace indentations 140A and the set of second trace indentations 140A' at the plurality of points along the length of the second antenna trace 140.

Figure 2:
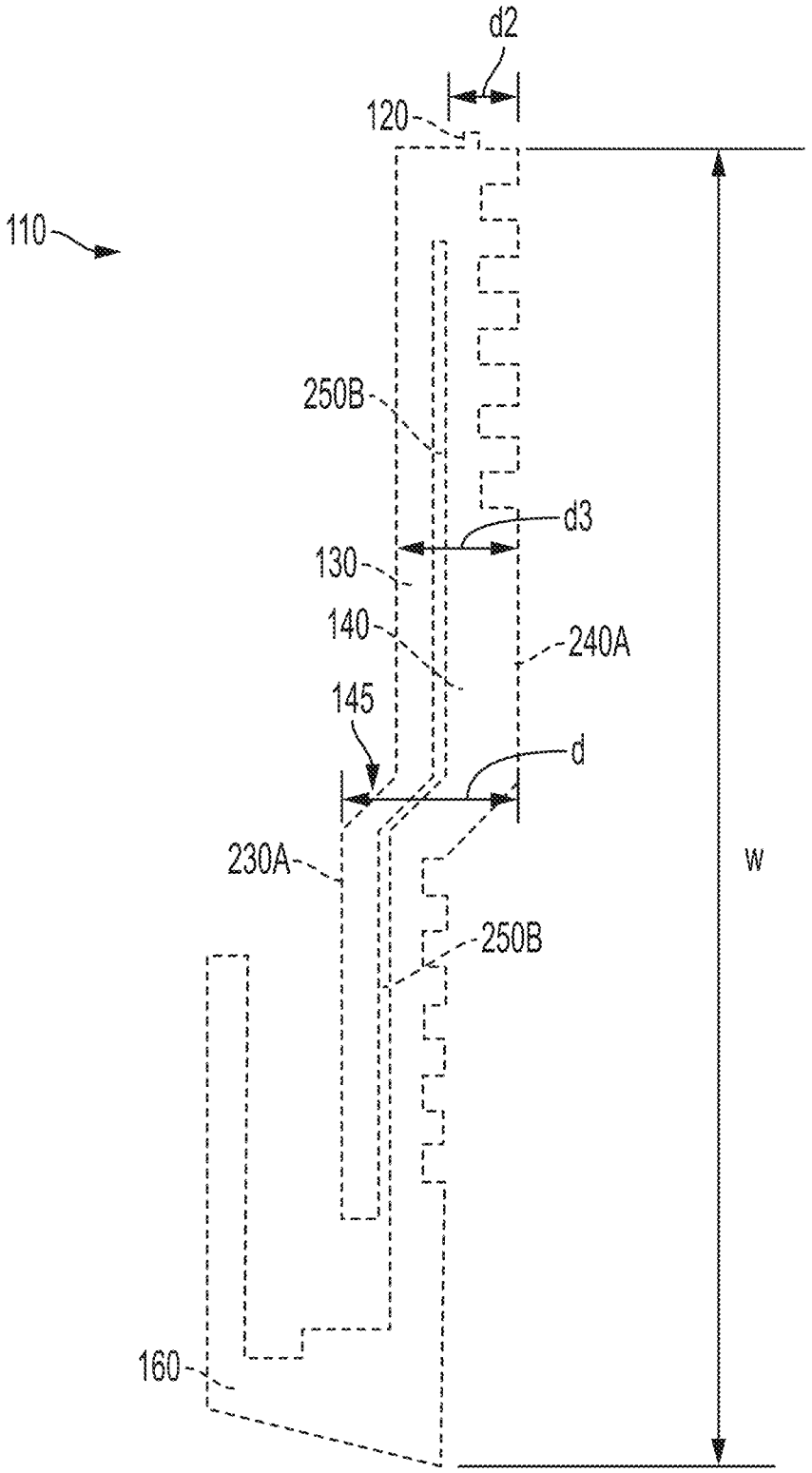
FIG. 2 is a detailed plan view of the trace antenna of FIG. 1.

Turning to FIG. 2, a detailed plan view of the trace antenna of FIG. 1 without the circuit board is illustrated. The antenna 110 has a width w, a first distance d between a first antenna trace outer edge 230A and second antenna trace inner edge 240A at a location on a first side of the trace bend section 145, a second distance d2 from an edge of the feed point 120 and the second antenna trace inner edge 240A, and a third distance d3 between a first antenna trace outer edge 230A and second antenna trace inner edge 240A at a location on a second side of the trace bend section 145. A constant gap 250B is illustrated between the first antenna trace 130 and the second antenna trace 140.

Figure 3A:
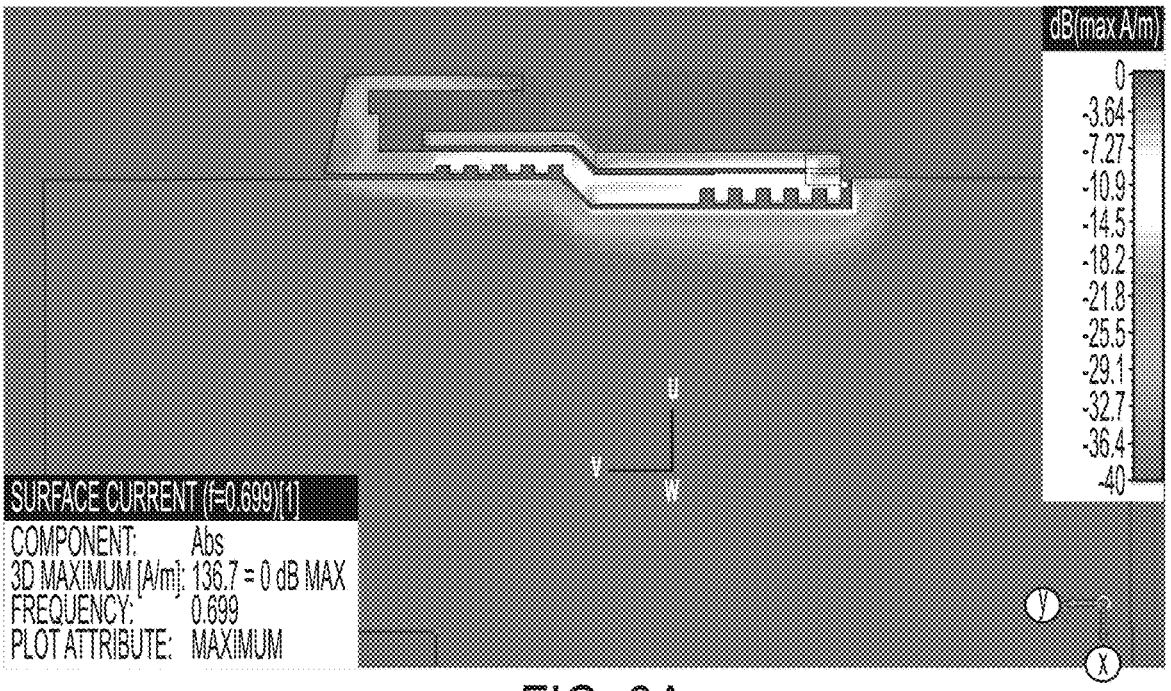
FIGS. 3A-B are a simulated current distribution response of the trace antenna of FIG. 1 at operating frequency bands of 699 MHz (FIG. 3A) and 800 MHz (FIG. 3B)
Figure 3B:
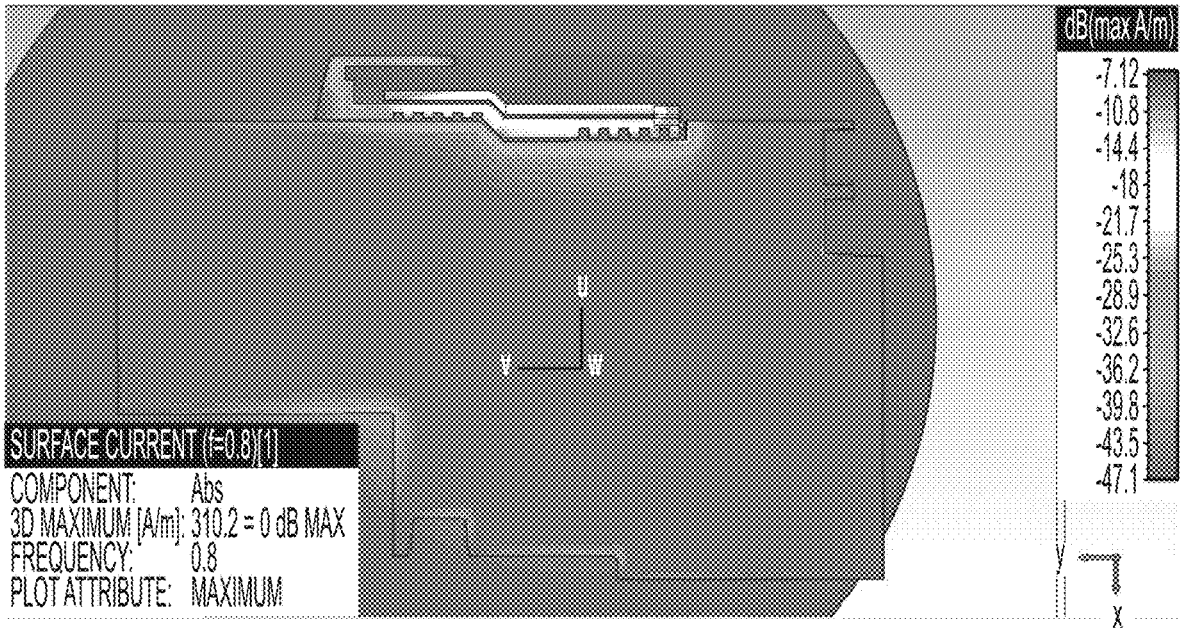
Figure 4A:
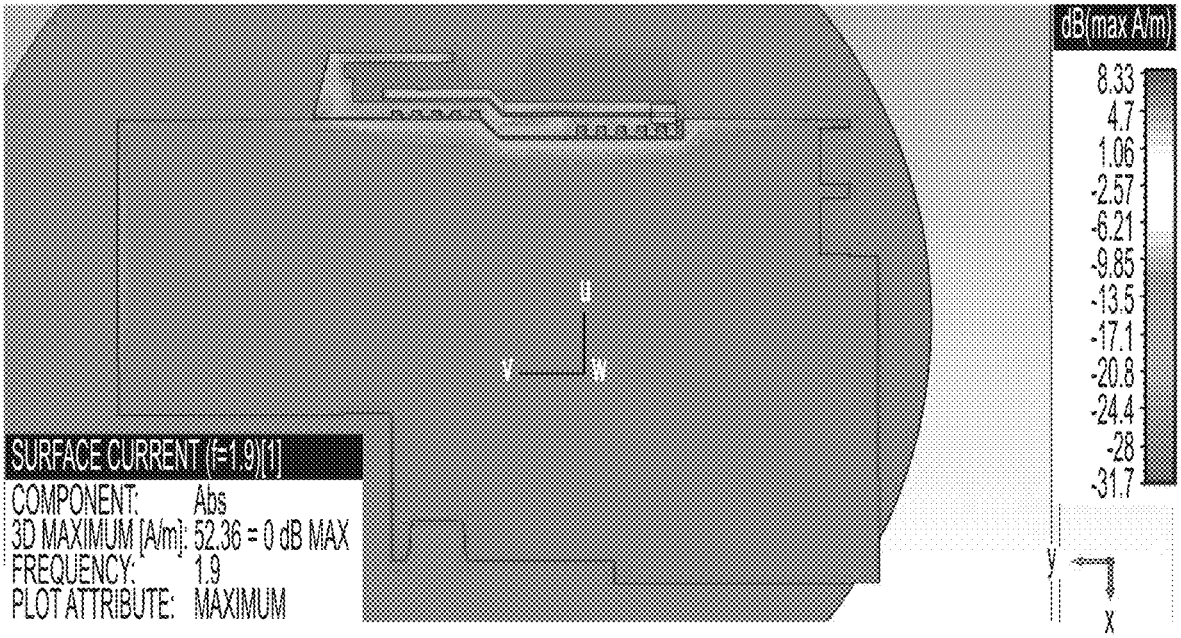
FIGS. 4A-B are simulated current distribution response of the circuit board trace antenna of FIG. 1 at operating frequency bands of 1.9 GHz (FIG. 4A) and 2.1 GHz (FIG. 4B)
Figure 4B:
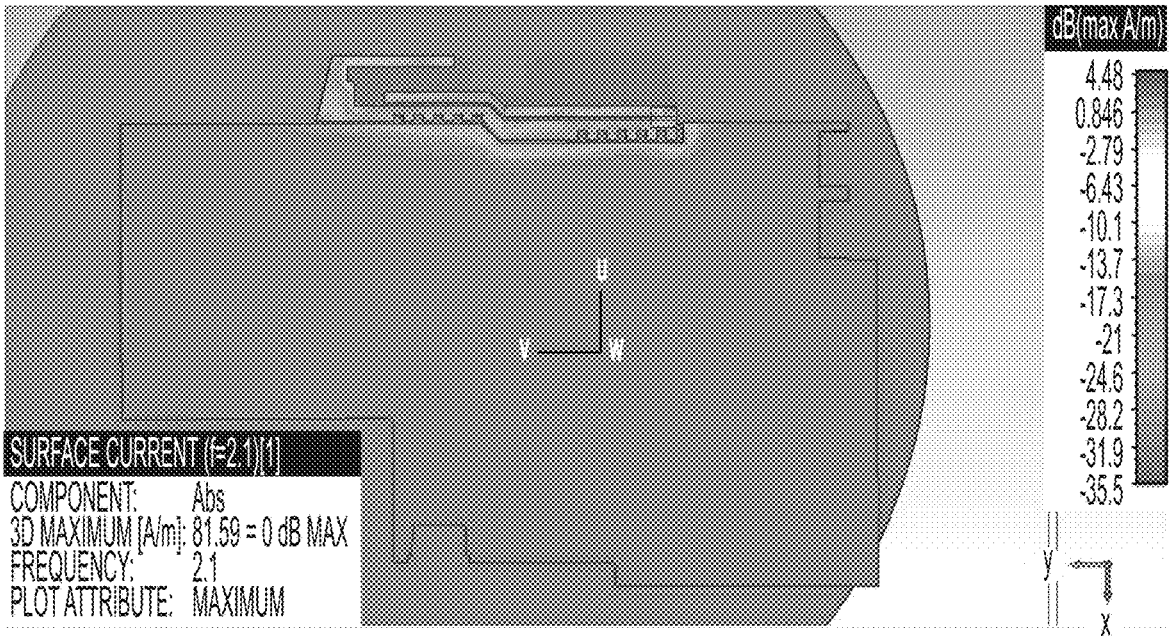
Figure 5:
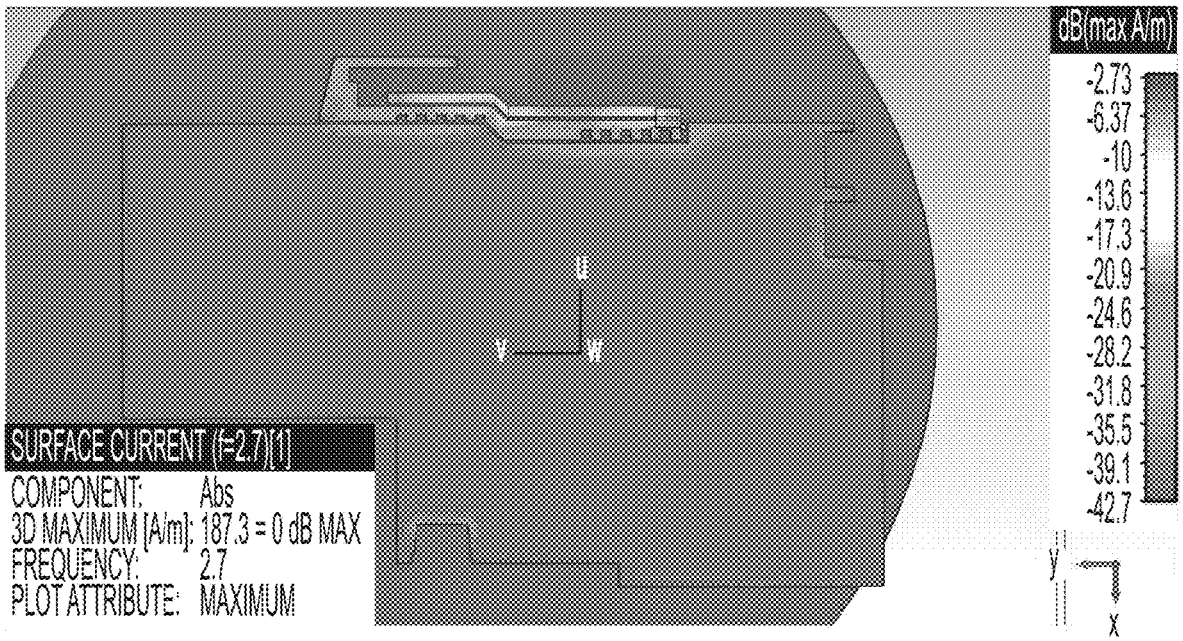
FIG. 5 is a simulated current distribution response of the circuit board trace antenna of FIG. 1 at an operating frequency band of 2.7 GHz.

Referring to FIGS. 3-5, a current distribution of the antenna 110 when operating at various frequencies is illustrated is described. Specifically, the current distributions of the multi-band trace antenna when operable at frequencies of 699 MHz (FIG. 3A), 800 MHz (FIG. 3B), 1.9 GHz (FIG. 4A), 2.1 GHz (FIG. 4B) and 2.7 GHz (FIG. 5) are provided. Most notably, the current distributions illustrate how the ground plane adjacent the ground plane edge 150A is excited by the close coupling of the first antenna trace 130 and the second antenna trace 140 at the selected lower operational frequencies of the antenna; whereas the provision of the first trace indentations 140A and the second trace indentations 140A' improves current distribution within the first antenna trace 130 at higher operational frequencies.

It will be appreciated that there has been described herein an exemplary arrangement of a circuit board including a multi-band antenna. Various modifications can be made to that described herein without departing from the scope of the present teaching. For example, rather than a monopole antenna, the first antenna trace 130 and the second antenna trace 140 could be laid out to provide a Planar Inverted-F Antenna (PIFA). Also, the dielectric of the circuit board may be chosen such that its properties may also determine or be chosen to modify the frequency response of the antenna.

Figure 6:
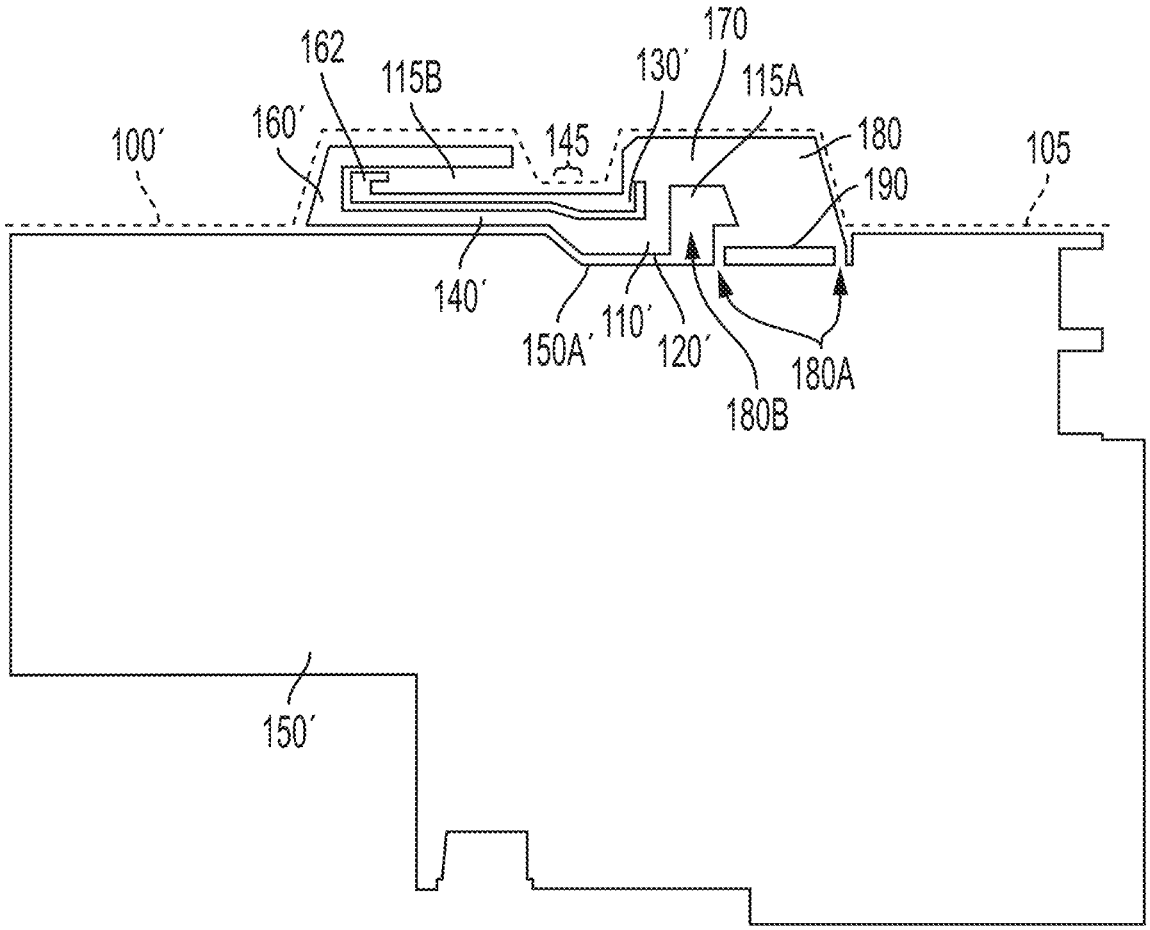
FIG. 6 is a plan view of one layer of a circuit board comprising a trace antenna according to a second configuration of the present disclosure.

Referring now to FIG. 6, in another configuration of the antenna, one layer of a circuit board 100' includes the first antenna trace 130', the second antenna trace 140' and third antenna trace 170 for a PIFA 110' and ground plane 150'. Again, the PIFA 110' is incorporated within the layer towards the circuit board edge 105 as described above for antenna 110 in FIGS. 1-2.

In the configuration shown in FIG. 6, a feed point 120' for the PIFA 110' is located adjacent to the circuit board edge 105, but shifted more towards the center of the first wing 115A and the second wing 115B, than to the end of one of the wings as shown in the configuration shown in FIG. 1. The feed point 120' is again connected to a pair of the closely coupled antenna traces, e.g., first antenna trace 130' and the second antenna trace 140', of unequal length extending away from the feed point 120' and similar in configuration to the first antenna trace 130 and the second antenna trace 140 of the configuration shown in FIG. 1 with the longer of the second antenna trace 140' including a second antenna trace loop section 160' extending around the second wing 115B. The feed point 120' is further connected to a third antenna trace 170, the third antenna trace 170 extending away from the feed point 120' generally in the direction of the circuit board edge 105 and opposite the direction of the closely coupled first antenna trace 130' and second antenna trace 140'. In the configuration shown in FIG. 6, the third antenna trace 170 comprises a third antenna trace loop section 180 extending away from the feed point 120', around the first wing 115A with a distal end 190 of the third antenna trace 170 connecting back to the ground plane 150' at two spaced-apart points 180A. The trace sections at the two spaced-apart points 180A act as inductive legs shorting the third antenna trace 170 directly to ground. Alternatively, a pair of lumped elements, such as inductors (not shown), can be connected between the distal end 190 of the third antenna trace 170 to the ground plane edge 150A' at the two spaced-apart points 180A and/or connected from the distal end 190 of the third antenna trace 170 across a third antenna trace gap 180B to the feed point 120'.

As will be appreciated, the third antenna trace 170 extending around a section of the first wing 115A enables refined tuning of the PIFA 110' without unduly occupying inboard space within the circuit board 100'.

Note that still further variations of the configuration shown in FIG. 6 are possible and for example, the first trace indentations 140A and second trace indentations 140A' shown in FIG. 1 could be incorporated within the second antenna trace 140' of the configuration shown in FIG. 6.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A circuit board including a multi-band trace antenna, the circuit board comprising:

a feed point adjacent an edge of the circuit board, the feed point being connected to a first antenna trace closely coupled to a second antenna trace, wherein the first antenna trace and the second antenna trace are of unequal length, wherein the first antenna trace extends away from the feed point along the edge of the circuit board, and wherein the second antenna trace extends away from the feed point inboard of the first antenna trace, a ground plane coplanar with the first antenna trace and the second antenna trace, an edge of the ground plane extending alongside and closely coupled with the second antenna trace to cause an area of the ground place adjacent the edge of the ground plane to radiate at a selected lower operational frequency of the antenna, and a pair of wings extending outwards along the edge of the circuit board, each wing of the pair of wings being separated to define a gap;

wherein an edge of the second antenna trace is indented to vary a width of the second antenna trace at a plurality of points along a length of the second antenna trace and to increase radiation of the first antenna trace at a selected higher operational frequency of the antenna, wherein the second antenna trace further comprises a loop section extending in a direction away from the ground plane, the loop section extending over a surface of one of the wings.

2. The circuit board according to claim 1, wherein the second antenna trace is indented by one or more of a square shaped section, a rectangular shaped section, a triangular shaped section, an irregular shaped section, an undulating indentation, and a combination of different shaped sections.

3. The circuit board according to claim 1, wherein the second antenna trace is indented at a first end of the second antenna trace, the first end being an end closest to the feed point, and indented at a second end of the first antenna trace, the second end displaced away from the feed point and at an opposite end from the first end.

4. The circuit board according to claim 1, wherein the second antenna trace is spaced away from the edge of the ground plane by a distance of about 0.6 mm.

5. The circuit board according to claim 1, wherein the first antenna trace is spaced away from the second antenna trace by a distance of about 0.7 mm.

6. The circuit board according to claim 1, wherein the multi-band trace antenna comprises a monopole antenna.

7. The circuit board according to claim 1, wherein the multi-band trace antenna is configured to operate in a frequency range of 600 MHz, to 2.7 GHz.

8. The circuit board according to claim 1, wherein a dielectric of the circuit board and a trace of the feed point are chosen to match an impedance of the antenna with a transceiver circuit.

9. The circuit board according to claim 1, wherein the feed point comprises one of a Pi matching network or a T matching network.

10. The circuit board according to claim 1, wherein the circuit board comprises a printed circuit board.

11. The circuit board according to claim 1, wherein the loop section further overlaps at least a portion of the first antenna trace.

12. The circuit board according to claim 1, wherein the loop section extends in a direction away from the ground plane by about 8 mm.

13. The circuit board according to claim 1, wherein an inboard side of the second antenna trace includes a plurality of rectangular indentations.

14. The circuit board according to claim 1, wherein a proximal portion of the second antenna trace extends in a first direction away from the feed point inboard of the first antenna trace, and wherein a distal portion of the second antenna trace extends in a second direction opposite the first direction outboard of the first antenna trace.

15. The circuit board according to claim 14, wherein the distal portion of the second antenna trace is part of the loop section of the second antenna trace.

16. The circuit board according to claim 1, wherein a distal end of the first antenna trace extends between a proximal portion of the second antenna trace and a distal portion of the second antenna trace.

17. The circuit board according to claim 1, wherein at least a portion of the second antenna trace is located a greater distance from the feed point than a furthest portion of the first antenna trace from the feed point.

18. The circuit board according to claim 1, wherein the loop section of the second trace extends away from the ground plane and loops back on itself to overlap at least a portion of the first antenna trace.

19. A circuit board including a multi-band Planar Inverted-F Antenna (PIFA) the circuit board comprising:

a feed point adjacent an edge of the circuit board, the feed point being connected to a plurality of traces;

a first antenna trace of the plurality of traces extending away from the feed point along the edge of the circuit board;

a second antenna trace of the plurality of traces extending away from the feed point inboard of the first antenna trace, the first antenna trace and the second antenna trace being of unequal length and being closely coupled along a coextensive length, the longer of the first antenna trace and the second antenna trace further comprising a loop section extending in a direction away from a ground plane;

a third antenna trace of the plurality of traces extending away from the feed point in a direction opposite that of the first antenna trace and the second antenna trace, the circuit board comprising the ground plane coplanar with the plurality of traces, an edge of the ground plane extending alongside and closely coupled with the second antenna trace of the plurality of traces to cause an area of the ground place adjacent the edge to radiate at a selected lower operational frequency of the PIFA; and a pair of wings extending outwards along the edge of the circuit board, each wing of the pair of wings being separated to define a gap, wherein the loop section extends over a surface of one of the wings and the third trace extends over a surface of the other of the wings.

20. The circuit board according to claim 19, wherein the second antenna trace of the plurality of traces is spaced away from the edge of the ground plane by a distance of about 0.6 mm.

21. The circuit board according to claim 19, wherein the first antenna trace of the plurality of traces is spaced away from the second antenna trace by a distance of about 0.7 mm.

22. The circuit board according to claim 19, wherein the multi-band trace antenna is configured to operate in a frequency range of 600 MHz to 2.7 GHz.

23. The circuit board according to claim 19, wherein a dielectric of the circuit board and at least one trace of the feed point are chosen to match the impedance of the antenna with a transceiver circuit.

* * * * *